United States Patent [19]

Swain et al.

[11] 4,266,578

[45] May 12, 1981

[54] DRILL PIPE PROTECTOR

[75] Inventors: Jack W. Swain, Bedford; Clarence T. Thomerson; Tom C. Waldrop, both of Corsicana, all of Tex.

[73] Assignee: Regal Tool & Rubber Co., Inc., Corsicana, Tex.

[21] Appl. No.: 23,169

[22] Filed: Mar. 23, 1979

Related U.S. Application Data

[63] Continuation-in-part of Ser. No. 679,727, Apr. 23, 1976, abandoned, and a continuation-in-part of Ser. No. 354,255, Apr. 25, 1973, abandoned.

[51] Int. Cl.[3] ..... F16L 57/00; E21B 17/10

[52] U.S. Cl. ..... 138/110; 138/96 R; 308/4 A; 166/241

[58] Field of Search ..... 138/97, 99, 96 R, 96 T, 138/109, 110, 113, 114, 159; 308/4 R, 4 A; 175/325; 166/241, 175

[56] References Cited

U.S. PATENT DOCUMENTS

| | | | |
|---|---|---|---|
| 1,965,998 | 7/1934 | Williams | 308/4 A |
| 1,974,546 | 9/1934 | Shipley | 308/4 A |
| 1,994,819 | 3/1935 | Hartson | 308/4 A |
| 2,002,893 | 5/1935 | Holt et al. | 308/4 A |
| 2,204,626 | 6/1940 | Scott | 308/4 A |
| 2,251,428 | 8/1941 | Smith | 138/96 R |
| 2,368,415 | 1/1945 | Grant | 308/4 A |
| 2,378,738 | 6/1945 | Smith | 308/4 A |
| 2,589,534 | 3/1952 | Buttolph . | |
| 2,604,365 | 7/1952 | Howard | 308/4 A |
| 2,693,986 | 11/1954 | Phreaner | 308/4 A |
| 2,739,018 | 3/1956 | Collett | 308/4 A |
| 2,860,013 | 11/1958 | Medearis | 308/4 A |
| 2,897,016 | 7/1959 | Baker | 308/4 A |
| 2,959,453 | 11/1960 | Jacobs | 308/4 A |
| 3,019,063 | 1/1962 | Collett | 308/4 A |
| 3,051,532 | 8/1962 | Collett | 308/4 A |
| 3,054,646 | 9/1962 | Minor | 308/4 A |
| 3,147,963 | 9/1964 | Frazier . | |
| 3,148,004 | 9/1964 | Hall et al. | 308/4 A |
| 3,197,262 | 7/1965 | Fairchild | 308/4 A |
| 3,320,004 | 5/1967 | Garrett | 308/4 A |
| 3,425,757 | 2/1969 | Minor | 308/4 A |
| 3,445,144 | 5/1969 | McBrien | 308/4 A |
| 3,449,022 | 6/1969 | Minor | 308/4 A |
| 3,480,094 | 11/1969 | Morris | 175/325 |
| 3,528,499 | 9/1970 | Collett | 166/175 |
| 3,588,199 | 6/1971 | Hopmans | 308/4 A |
| 3,612,627 | 10/1971 | Fuller | 308/4 A |
| 3,667,817 | 6/1972 | Kellner | 308/4 A |
| 3,741,252 | 6/1973 | Williams | 138/110 |
| 3,811,477 | 5/1974 | Thawley | 138/103 |
| 3,894,779 | 7/1975 | Hoon et al. | 308/4 A |
| 3,894,780 | 7/1975 | Broussard | 308/4 A |
| 3,902,531 | 9/1975 | Thawley | 138/137 |
| 3,942,824 | 3/1976 | Sable | 308/4 A X |
| 4,042,023 | 8/1977 | Fox | 166/241 |

*Primary Examiner*—James E. Bryant, III

*Attorney, Agent, or Firm*—Gerald G. Crutsinger; John F. Booth; Harry C. Post, III

[57] ABSTRACT

A cylindrical drill pipe protector (10) having a skeleton (34,36) with inner (40) and outer (42) layers of rubber bonded to the skeleton.

9 Claims, 4 Drawing Figures

DRILL PIPE PROTECTOR

BACKGROUND ART

This application is a continuation of Application Ser. No. 679,727, filed Apr. 23, 1976, and a continuation in-part of Ser. No. 354,255 filed Apr. 25, 1973, both applications now abandoned.

TECHNICAL FIELD

This invention relates to protective devices adapted to be mounted on drill pipe and the like for use during rotary drilling of oil, gas, water or in similar well bores, and more specifically relates to a protector having an improved cylindrical skeleton with an inner layer of rubber contacting the drill pipe and an outer layer of rubber for maintaining the drill pipe spaced from the wall of the bore.

In drilling oil wells, drill pipe protectors are used. These protectors are in the form of collars or sleeves and are are generally tubular in form and made of rubber externally sized to be larger in diameter than the tool joint and adapted to be secured to the drill pipe.

It is highly desirable that once placed on the drill pipe, relative motion between the pipe and protector be eliminated. For this purpose, various means have been employed heretofore in order securely to affix the collar to the drill pipe. Prior devices have been characterized by two basic approaches. In a first approach, a cylindrical skeleton is provided coated inside and out with rubber and with openings in the skeleton to allow flow of rubber material therethrough when the rubber is distorted by clamping the same to the drill pipe. Such a protector is shown in the patent to Smith, U.S. Pat. No. 2,251,428. These protectors in general have been found to be undesirable in that the constant working of the protector by impact with the borehole wall generates a pumping action responsive to which drill fluid flows along the pipe into and out of the pockets into which the rubber flows, causing fluid cutting of the drill pipe. At the same time, the mounting between the protector and the drill pipe is somewhat compromised.

A second approach has been based upon the belief that there must be actual direct contact, metal to metal, between the skeleton of the protector and the drill pipe. An example of a protector according to this approach is shown in the patent to Hall, U.S. Pat. No. 3,148,004.

It has been found that neither of the foregoing approaches represents an optimum.

DISCLOSURE OF THE INVENTION

In accordance with the present invention, a drill pipe protector is provided wherein a cylindrical circumferentially ribbed skeleton has a longitudinal wedge lock. A continuous thin resilient layer of rubber is bonded to the interior of the skeleton.

A continuous resilient outer layer of rubber of relatively thick dimension is bonded to the skeleton and to the inner layer.

According to another embodiment of the present invention, the two layers can be of different materials.

For a more complete understanding of the present invention and for further objects and advantages thereof, reference may now be had to the following description taken in conjunction with the accompanying drawings in which:

DETAILED DESCRIPTION

Figure 1:
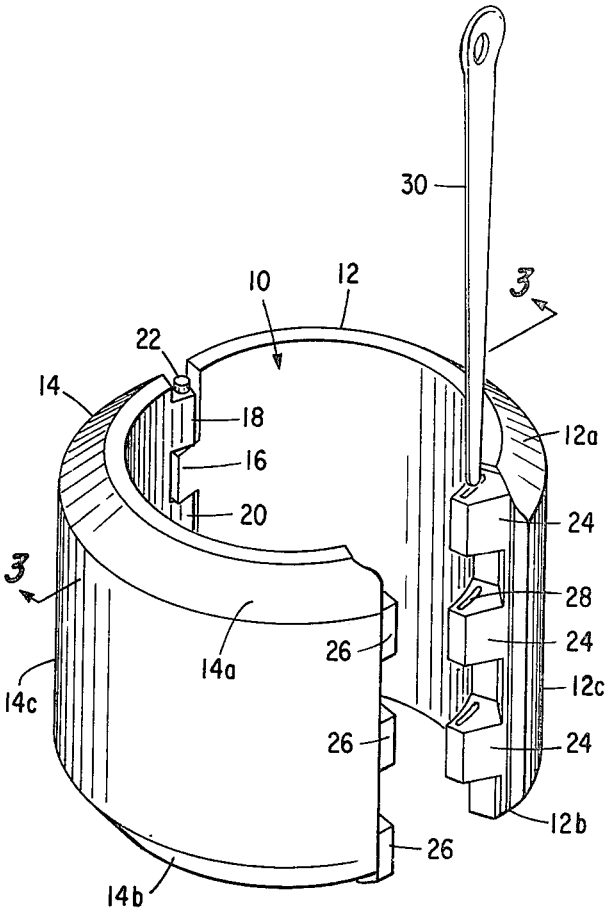
FIG. 1 is an isometric view of an embodiment of the invention preparatory to securing the same to a drill pipe.

Referring first to FIG. 1, there is illustrated a drill pipe protector 10 formed of two halves 12 and 14, each semicylindrical in shape. The edges are toothed with a longitudinal bore extending therethrough. More particularly, the edge of unit 12 has a hinge protrusion 16 which mates between protrusions 18 and 20 of element 14. Thus, a butt hinge is in effect formed to interconnect the halves 12 and 14 together at the rear or spine thereof with a pin 22 serving as the pivot therebetween. At the front of the protector similar hinge projections 24 are formed on element 12 and projections 26 are formed on element 14. A tapered hole 28 is formed through the projections 24 and 26 to receive a tapered drive pin 30 which when driven home, as shown in FIG. 2, draws the halves 12 and 14 tightly together to form a unitary cylinder.

Figure 2:
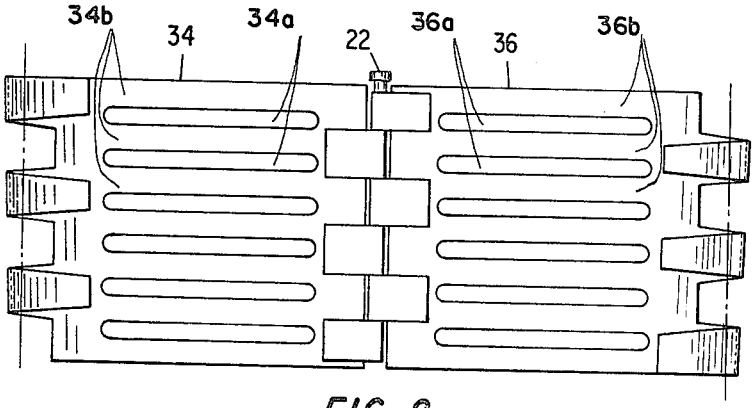
FIG. 2 is a view of the improved skeleton used in the unit of FIG. 1, shown in planer form.

As shown in FIG. 2 and according to a particular feature of the present invention, skeleton halves 34 and 36 are each provided with a single array of circumferential ribs and slots. Each half 34 or 36 supports inner layers and outer layers of rubber bonded onto the skeleton. Loops in the skeleton at the end of halves 34 and 36 receive pins 22 and 30.

This feature of invention is illustrated in FIG. 2, where a single array of parallel slots are shown formed in each of sections 34 and 36 and are coextensive in length with each other. Slots 34*a*, for example, in the skeleton half 34 are spaced apart by ribs 34*b*. Ribs 34*b* occupy roughly 60% of the width of the skeleton 34 and extend the length thereof and are joined along a line marking the ends of slots 34*a* just short of the folded portions employed for the hinge and the taper locks. In the embodiment shown, the combined length of the array of slots 34*a* and the array of slots 36*a* comprises a major fraction of the circumference of the cage formed thereby. According to one embodiment, each rib is of a length substantially greater than twice the width thereof.

Figure 3:
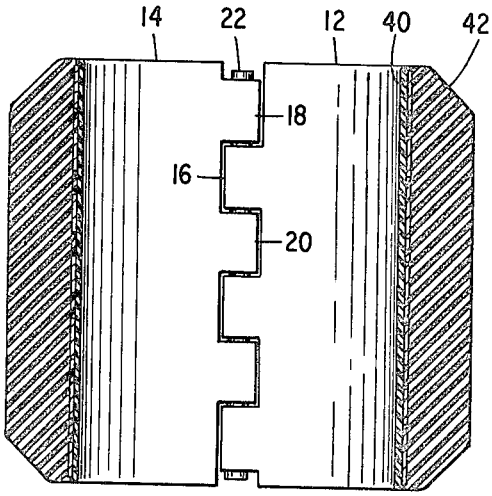
FIG. 3 is a sectional view taken along the lines 3—3 of FIG. 1.

As seen from FIG. 3, the height of the cage exceeds the diameter of the pipe to be protected.

In the sectional view shown in FIG. 3, it will be apparent that the protector is formed by vulcanizing an inner rubber layer 40 and an outer rubber layer 42 to skeleton halves 34 and 36. The inner rubber layer is relatively thin, preferably of the order of about 1/16 inch. The outer rubber layer preferably is of the order of one or more inches in thickness. As above noted, the total thickness is such that the outer diameter of the protector exceeds the diameter of the tool joint thereby to protect the same from contact with the borehole wall.

In accordance with a second feature and alternative of the present invention, the physical charateristics of the rubber layer 40 and rubber layer 42 are significantly different. It is to be understood of course that this feature of the invention is in addition to the design of the skeleton halves. Not only is the inner layer 40 made relatively thin, but it is made of a rubber material having a coefficient of compression setting which is very low. This means that the rubber layer 40 may be drawn into interference contact with the outer wall of the drill pipe and maintained under high compression by the forces produced when pin 30 is driven into the tapered slots at the front of the unit. Under such compression, the connection between the protector and the drill pipe will be maintained because the rubber maintains its resiliency by reason of its low compression set coefficient.

The outer layer 42 is made of material which has a high abrasion resistant property.

By way of example, in one embodiment of the invention skeleton 30 was made out of 4130 steel of thickness of 0.050 inches and had a tensile strength of 95,000 p.s.i.

By reason of the fact that the slots **34*a* are parallel one to the other and extend substantially the length of the skeleton half 34, a plurality of tensile bands are formed to be placed under such tension and stress as necessary to maintain the rubber layer 40 under high compression. It will be apparent that because of the ratio of length to width of the ribs 34*b*, a plurality of independently workable bands apply forces to the wall of the pipe through the rubber layer 40 and individually oppose translation along the length of the pipe by reason of the stress in the bands necessary to maintain rubber layer 40** under high compression.

The rubber layers 40 and 42 had the following physical characteristics:

| Physical Properties | Outer Layer 42 | Inner Layer 40 |
|---|---|---|
| Tensile Strength (p.s.i.) | 3200 | 1400 |
| Ultimate Elongation (%) | 700 | 300 |
| Modulus of Elasticity (p.s.i.) | | |
| (at 100%) | 220 | 475 |
| (at 200%) | 420 | 1050 |
| (at 300%) | 780 | 1400 |
| Tear Resistance | 250 | 250 |
| Hardness (Shore A) | 60 | 80 |
| Compression Set (%) | 72.5 | 44.0 |
| Volume Change* (%) | −1.74 | +0.85 |
| Hardness Change (Shore A) | +6 | +3 |

*After 70 hours at 300° in ASTM #3 oil

The rubber used employs a high acrylonitrile butadiene copolymer of the general type referred to as a nitrile base polymer. The compound is designed to have the above properties for operation under downhole drilling conditions. The 60 to 65 durometer hardness in the outer layer 42 has been found to be the best for combined resilience and of greatest resistance to abrasive wear. A high acrylonitrile content of the copolymer provides for oil and fuel resistance, high tensile and tear strength, abrasion and gas impermeability resistance, and heat resistance. The nitrile copolymer is compounded and processed with other chemical materials to obtain a stable hardness and to enhance the desired properties. The pipe protector rubber has been recommended serviceable up to 250° for prolonged use. However, the rubber has been successfully used in environments as high as 350° F. where there is some lubrication in drilling muds. The bonds obtained between the rubber to the steel inserts are enhanced by extensive cleaning methods. All dirt, grease, scale and other foreign materials preferably are removed from the inserts by tumble blasting down to bright metal. This exposed surface preferably is then vapor degreased and solvent washed to remove dust. A primer is used which yields the most reproducible bonding results.

Any polymer can be compounded with other materials to obtain a spectrum of hardness and other physical properties desired. However, rubbers employed herein each has a specific set of physical properties. In the present case, the outer rubber 42 is designed primarily for abrasive resistance, tensile strength, tear strengths and bondability along with good heat and gas penetration resistance. A compound designed for maximum gas resistance alone would be much harder and the abrasion resistance less.

The rubber forming the inner layer is used primarily for gripping the pipe. The high modulus the lower elongation and higher hardness and the lower compression set cooperate towards that particular aspect of its use.

The rubber is at least in part fashioned by control of the amounts and kinds of hardening materials employed. For example, the outer layer 42 preferably will employ a carbon black which will provide a high abrasion resistance such as carbon black generally known in the industry as H.A.F. Black or high abrasion furnace black.

Inner layer 40 preferably employs carbon black of a different type one of which is known as S.R.F. Black or semireinforcing furnace black and another of which is known as M.T. Black or medium thermal black.

The rubber layers preferably are made to have the physical properties set out above wherein the inner and outer layers have distinctively different character.

In the unit of FIGS. 1–3 the outer wall of the protector is smooth and unbroken over each half 12 and 14 with the upper edges **12*a* and 14*a* being tapered or conical as are the lower edges 12*b* and 14*b*. The wall portions 12*c* and 14*c*** are smooth and cylindrical.

Figure 4:
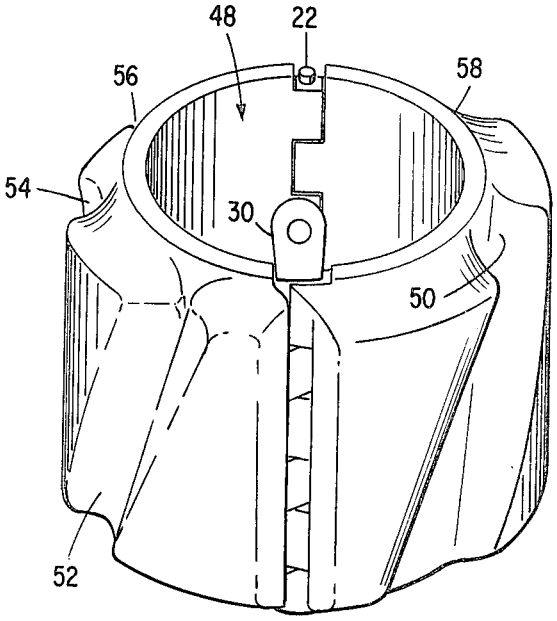
FIG. 4 is a similar view of a modified form of the invention in a cylindrical form.

In the embodiment illustrated in FIG. 4, the outer walls are grooved, the grooves 50–58 being seen in FIG. 4. The grooves are generally of spiral shape and provide a means to channel drill fluid past the protector 48. However, the inner walls and outer walls are of the same general physical properties as the layers 40 and 42 of FIG. 3.

Having described the invention in connection with certain specific embodiments thereof, it is to be understood that further modifications may now suggest themselves to those skilled in the art and it is intended to cover such modifications as fall within the scope of the appended claims.

What is claimed is:

1. A protector for a drill pipe, which protector comprises:

(a) a pair of unitary semi cylindrical tension bearing metallic skeleton members, each skeleton member having an axially directed hinge joint and each skeleton member of said pair having a wedge receiving lock structure at a longitudinal joint diametrically opposite said hinge joint, each skeleton member of said pair having a semi cylindrical inner periphery and an axial length equal to at least about the diameter of the drill pipe to be protected and each skeleton member of said pair having a plurality of uninterrupted elongated circumferentially extending parallel openings forming therebetween an array of a plurality of ribs with circumferentially aligned ends, the ends of said openings are adjacent to said hinge joint and said lock structure and the ends of said openings are aligned parallel to said hinge joint and said lock structure, each of said ribs having an unsupported span between the ends thereof;

(b) a thin uniform continuous resilient inner layer bonded to each of said members and forming smooth continuous semi cylindrical inner walls of resilient material for gripping the exterior of said drill pipe;

(c) a thick resilient outer layer bonded to each of said members and to said inner layers; and (d) a wedge of a few degrees taper for releasably applying a force through said wedge lock to apply a high compressional force to said inner layer at zones beneath said ribs whereby said protector is contracted around and grips said drill pipe to resist displacement of said protector on said drill pipe.

2. A combination of claim 1 wherein the axial width of said ribs occupy about 60% of the width of said skeleton.

3. The combination of claim 1 wherein said skeleton is of steel of tensile strength of about 95000 psi.

4. The combination of claim 2 wherein said skeleton is of steel of about 0.050 inches thick.

5. In a protector for mounting on a drill pipe, said protector including first and second unitary semi cylindrical skeletal halves, said semi cylinders being formed from a metallic material, a hinge means joining said semi cylinders together, lock means for releasably connecting said semi cylinders around a drill pipe, a continuous inner layer of resilient material bonded to the interior of each of said semi cylinders to form smooth continuous semi cylindrical inner wall on each of said semi cylinders, an outer layer of resilient material bonded to the exterior of each of said semi cylinders, the improvement which comprises each of said semi cylinders having a plurality of parallel circumferentially extending ribs, each rib is separated from the adjacent rib by a single uninterrupted elongated circumferentially extending opening formed in each of said semi cylinders to form an array of spaced ribs spanning the distance between said hinge means and said lock means whereby said semi cylinders when contracted around said pipe compresses said inner layer to resist displacement of said protector.

6. A protector as defined in claim 5 wherein the improvement further comprises said inner layer comprising a low compression setting rubber and said outer layer comprising an abrasion resistant rubber.

7. The combination of claim 5 wherein the combined axial widths of said ribs occupies about 60% of the axial width of said skeleton.

8. The combination of claim 5 wherein said skeleton is of steel of tensile strength of about 95000 psi.

9. The combination of claim 5 wherein said skeleton is of steel of about 0.050 inches thick.

* * * * *